US008499817B2

(12) United States Patent
Hu et al.

(10) Patent No.: US 8,499,817 B2
(45) Date of Patent: Aug. 6, 2013

(54) METHOD FOR MAKING CARBON NANOTUBE METAL COMPOSITE

(75) Inventors: Chun-Hua Hu, Beijing (CN); Chang-Hong Liu, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 12/905,428

(22) Filed: Oct. 15, 2010

(65) Prior Publication Data

US 2011/0180968 A1 Jul. 28, 2011

(30) Foreign Application Priority Data

Jan. 22, 2010 (CN) ..... 2010 1 0102120

(51) Int. Cl.
*B22D 19/14* (2006.01)

(52) U.S. Cl.
USPC ..... 164/97

(58) Field of Classification Search
USPC ..... 164/97, 98, 100, 101
See application file for complete search history.

(56) References Cited

U.S. PATENT DOCUMENTS

| | | | | |
|---|---|---|---|---|
| 4,108,643 | A * | 8/1978 | Flemings et al. | 148/400 |
| 2008/0293853 | A1 * | 11/2008 | Wolf et al. | 524/81 |
| 2009/0181239 | A1 | 7/2009 | Fan et al. | |

FOREIGN PATENT DOCUMENTS

| | | | |
|---|---|---|---|
| GB | 2275008 | * | 8/1994 |
| JP | 2007-77457 | A | 3/2007 |
| JP | 200777457 | | 3/2007 |
| KR | 2008073562 | * | 8/2008 |
| TW | 200934725 | A | 8/2009 |

* cited by examiner

*Primary Examiner* — Kevin P Kerns
(74) *Attorney, Agent, or Firm* — Altis Law Group, Inc.

(57) ABSTRACT

A method for making a carbon nanotube metal composite includes the following steps. A number of carbon nanotubes is dispersed in a solvent to obtain a suspension. Metal powder is added into the suspension, and then the suspension agitated. The suspension containing the metal powder is allowed to stand for a while. The solvent is reduced to obtain a mixture of the number of carbon nanotubes and the metal powder.

20 Claims, 3 Drawing Sheets

30

METHOD FOR MAKING CARBON NANOTUBE METAL COMPOSITE

RELATED APPLICATIONS

This application claims all benefits accruing under 35 U.S.C. §119 from China Patent Application No. 201010102120.4, filed on Jan. 22, 2010, in the China Intellectual Property Office, incorporated herein by reference.

BACKGROUND

1. Technical Field

The present disclosure relates to a method for making a carbon nanotube metal composite.

2. Description of Related Art

The discovery of carbon nanotubes has stimulated a great amount of research efforts around the world. Carbon nanotubes are characterized by the near perfect cylindrical structures of seamless graphite. Carbon nanotubes possess unusual mechanical, electrical, magnetic, catalytic, and capillary properties. A wide range of applications use carbon nanotubes as one-dimensional conductors in nanoelectronic devices, as reinforcing fibers in polymeric and carbon composite materials, as absorption materials for gases such as hydrogen, and as field emission sources.

In recent years, carbon nanotube metal composites have become a hot subject of research. However, there are still difficulties in the field of carbon nanotube metal composites. Because carbon nanotubes have great surface area and specific surface energy, it is difficult to evenly disperse the carbon nanotubes in a metal powder matrix. To solve this problem, carbon nanotubes undergo mechanical ball milling so they can be blended with metal particles to obtain a carbon nanotube metal composite. However, the structure of carbon nanotubes after mechanical ball milling may suffer serious damage.

What is needed, therefore, is to provide a method for making a carbon nanotube metal composite.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present method for making a carbon nanotube metal composite.

Figure 1:
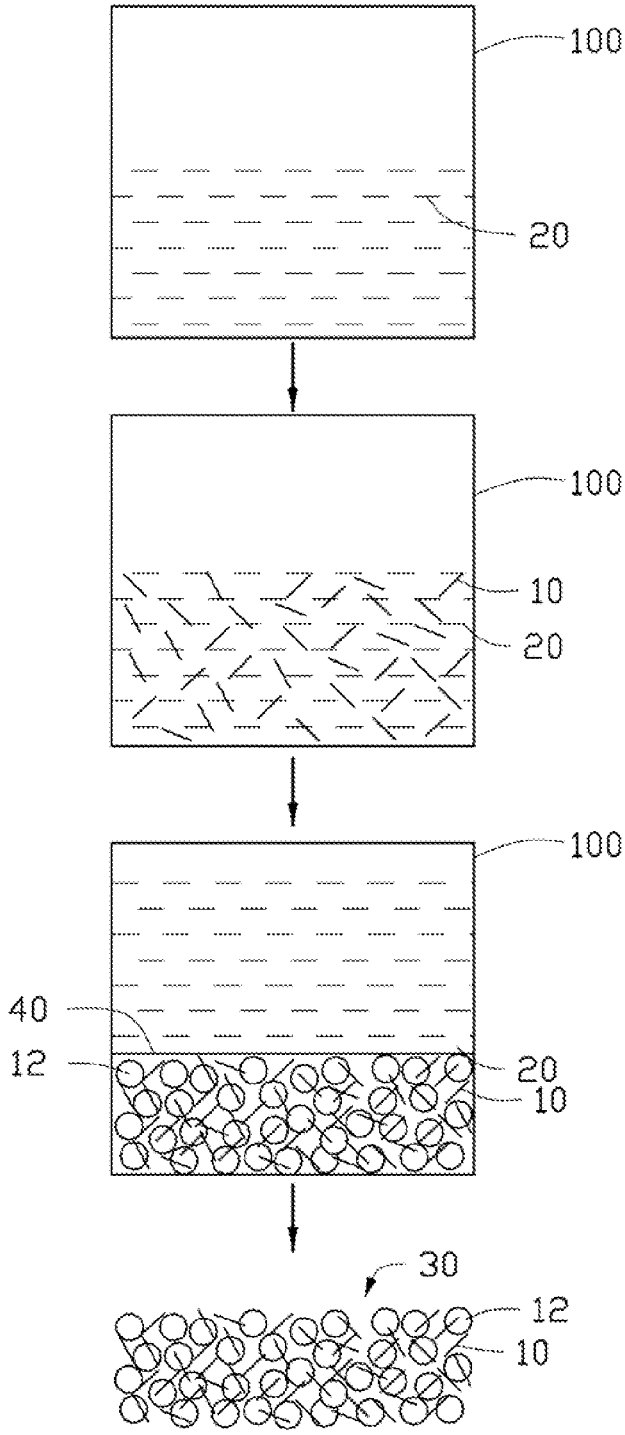
FIG. 1 is a schematic view of steps of one embodiment of a method of making a carbon nanotube metal composite.

Referring to FIG. 1, a method for making a carbon nanotube metal composite of one embodiment includes the following steps of:

(S10) dispersing a number of carbon nanotubes 10 in a solvent 20 to obtain a suspension containing the carbon nanotubes 10;

(S20) adding metal powders 12 into the suspension containing the carbon nanotubes 10, agitating the suspension containing the carbon nanotubes 10 to combine the carbon nanotubes 10 with the metal powders 12, and letting the suspension stand;

(S30) reducing the solvent 20 to obtain a mixture 30 of the carbon nanotubes 10 and the metal powders 12.

The carbon nanotubes 10 can be treated before step (S10) by the following substeps of:

(S101) providing and purifying the carbon nanotubes 10; and (S102) functionalizing the carbon nanotubes 10.

In step (S101), the carbon nanotubes 10 can be obtained by any method, such as chemical vapor deposition (CVD), arc discharging, or laser ablation. In one embodiment, the carbon nanotubes 10 are obtained by a CVD method including the following steps of:

providing a substrate;

forming a carbon nanotube array on the substrate by CVD; and peeling the carbon nanotube array off the substrate by a mechanical method, thereby achieving a number of carbon nanotubes.

The carbon nanotubes 10 can be single-walled carbon nanotubes, double-walled carbon nanotubes, multi-walled carbon nanotubes, or combinations of them. A diameter of each of the carbon nanotubes 10 can be less than about 50 nanometers. A length of each of the carbon nanotubes 10 can be less than about 2 micrometers. In one embodiment, the diameter of each of the carbon nanotubes 10 is less than about 50 nanometers, and the length of the carbon nanotubes 10 is in a range from about 50 nanometers to about 200 nanometers.

In step (102), the carbon nanotubes 10 can be chemically functionalized, which refers to the carbon nanotubes 10 being chemically treated to introduce functional groups on the surface. Chemical treatments include, but are not limited to, oxidation, radical initiation reactions, and Diels-Alder reactions. The functional groups can be any hydrophilic group, such as carboxyl (—COOH), aldehyde group (—CHO), amidogen group (—$NH_2$), hydroxyl (—OH), or combinations of them. After being functionalized, the carbon nanotubes 10 are easily dispersed in the solvent 20 by the provision of the functional groups.

In step (S10), the carbon nanotubes 10 can be treated by the substeps of:

(S12) filtrating the carbon nanotubes 10;

(S14) putting the carbon nanotubes 10 into the solvent 20 to obtain a mixture;

(S16) ultrasonically stirring the mixture.

In step (S10), the above steps are repeated about 4 to 5 times to obtain the suspension of the carbon nanotubes 10 and the solvent 20.

In step (S10), the solvent 20 can be alcohol, ethyl acetate, or N,N-Dimethylformamide (DMF). The carbon nanotubes 10 can be added into a container 100 containing the solvent 20. The carbon nanotubes 10 can be dispersed in the solvent 20 by a method of ultrasonic dispersion. After ultrasonic dispersion, the carbon nanotubes can be evenly dispersed in the solvent 20 to form the suspension. Because the carbon nanotubes 10 are evenly dispersed in the suspension, the carbon nanotubes would not deposit even after long standing time of the suspension. Additionally, in the process of the ultrasonic dispersion, static charges formed on the carbon nanotubes 10. In one embodiment, the solvent is DMF, and the time of ultrasonic dispersion is in a range from about 10 minutes to about 30 minutes.

In step (S20), the metal powders 12 are added in the suspension containing the carbon nanotubes 10. The carbon nanotubes 10 in the solvent 20 adhere to the metal powders 12 by electrostatic force between the carbon nanotubes 10 and the metal powders 12 in the process of agitating. The carbon nanotubes 10 combine with the metal powders 12 and deposit on the bottom of the container 100. After standing, the carbon nanotubes 10 deposit on the bottom of the container 100 with the metal powders 12. Two layers are formed in the container 100. There is a boundary 40 between the two layers, the layers being an upper layer and a bottom layer. The upper layer in the container 100 comprises mostly the solvent 20. The bottom layer in the container 100 comprises mostly of the carbon nanotubes 10 and the metal powders 12. The carbon nanotubes 10 are evenly dispersed in a matrix made of the metal powders 12 at the bottom layer in the container 100.

The metal powders 12 can be made of metal or alloy. A volume ratio of the metal powders 12 to the carbon nanotubes 10 can be in a range from about 1:1 to about 50:1. The metal powders 12 can be made of magnesium (Mg), zinc (Zn), manganese (Mn), aluminum (Al), thorium (Th), lithium (Li), silver (Ag), lead (Pb), or calcium (Ca). The metal powders 12 can be made of an alloy which includes magnesium and any combination of elements, such as Zn, Mn, Al, Th, Li, Ag, and Ca. A mass ratio of the magnesium metal to the other elements in the alloy can be more than 4:1. In one embodiment, the metal powder 12 is Pb powder. The volume ratio of the Pb powder to the carbon nanotubes is 20:1.

The step (S30) can include the following substeps of:

(S301) filtering out the solvent 20 to obtain the mixture 30 of the carbon nanotubes 10 and the metal powder 12;

(S302) drying the mixture 30 of the carbon nanotubes 10 and the metal powder 12.

In step (S301), the solvent 20 in the upper layer of the container 100 can be poured out of the container 100. The carbon nanotubes 10 and the metal powder 12 can be filtered by filter paper.

In step (S302), the mixture 30 of the carbon nanotubes 10 and the metal powder 12 can be put into a vacuum oven to evaporate remains of the solvent 20. A temperature of the vacuum oven can range from about 40° C. to about 50° C. for a period of time (e.g. about 10 minutes to about 60 minutes).

Figure 2:
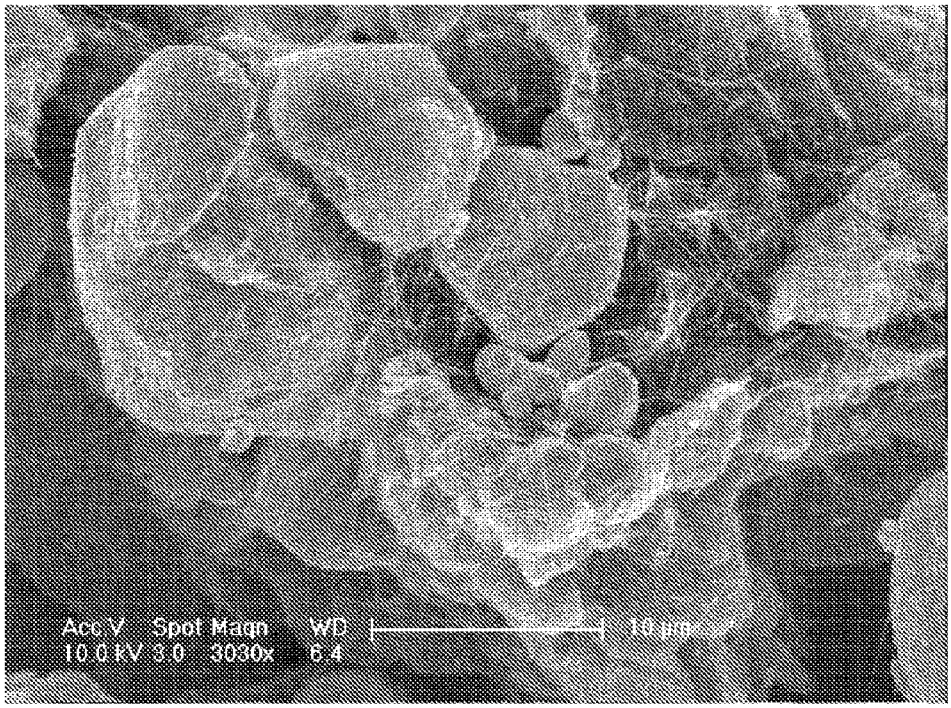
FIG. 2 is a Scanning Electron Microscope image of one embodiment of the carbon nanotube metal composite.

FIG. 2 is an SEM image of a mixture of the carbon nanotubes and the Pb powder of one embodiment. As can be seen in FIG. 2, the carbon nanotubes are evenly dispersed in a mixture of the Pb powder. The carbon nanotubes are attracted to the surface of each of the Pb powder particles.

A method for making a carbon nanotube metal composite of one embodiment includes the following steps:

(S10) dispersing a number of carbon nanotubes 10 in a solvent 20 to obtain a suspension containing the carbon nanotubes 10;

(S20) adding metal powder 12 into the suspension containing the carbon nanotubes 10, agitating the suspension containing the carbon nanotubes 10 to make the carbon nanotubes 10 combine with the metal powders 12, and letting the suspension stand;

(S30) reducing the solvent 20 to obtain a mixture 30 of the carbon nanotubes 10 and the metal powder 12.

(S40) treating the mixture 30 of the carbon nanotubes 10 and the metal powder 12 with a molding process.

In step (S40), in one embodiment, the mixture 30 of the carbon nanotubes 10 and the metal powder 12 is treated by the following substeps of:

heating the mixture 30 in a protective gas to achieve a semi-solid-state paste;

stirring the semi-solid-state paste using an electromagnetic stirring force to disperse the carbon nanotubes into the paste;

injecting the semi-solid-state paste into a die; and cooling the semi-solid-state paste to achieve a carbon nanotube metal composite.

Figure 3:
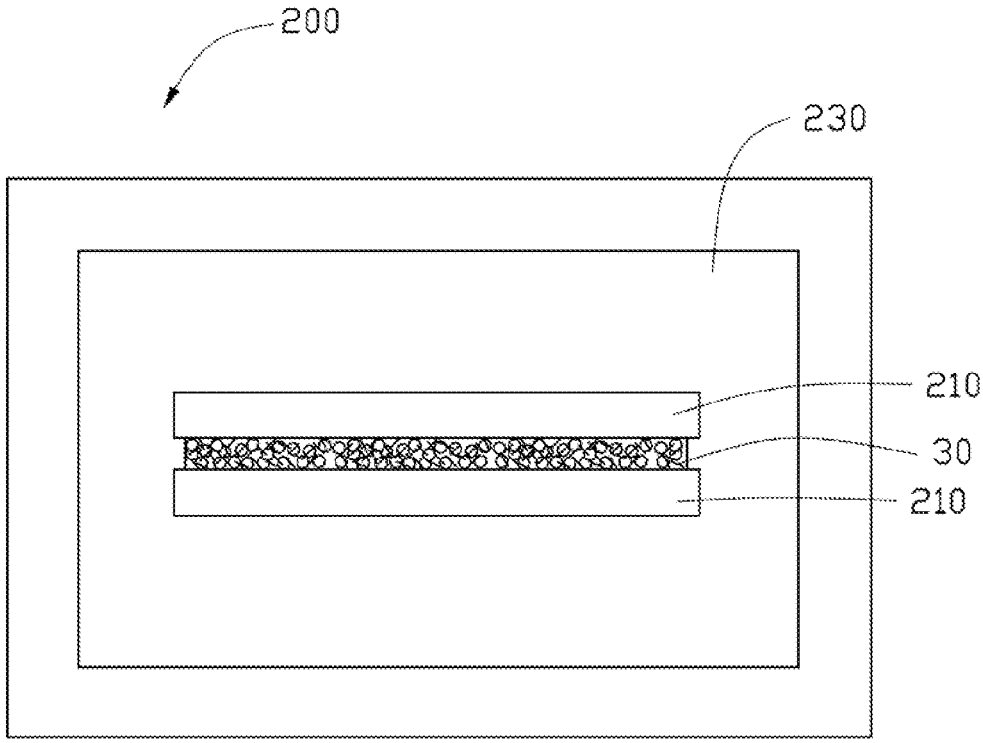
FIG. 3 is a schematic view of a hot-pressing step of one embodiment of a method making a carbon nanotube metal composite.

Referring to FIG. 3, a hot-pressing machine 200 includes a container 230, and two boards 210 positioned in the container 230. The boards 210 can be heated to a predetermined temperature. A vacuum pump (not shown) can be connected to the container 230 to evacuate the air in the container 230. A protective gas can be pumped into the container 230 through a pipe (not shown in FIG. 3) connected thereto. The protective gas can be nitrogen (N2) and/or a noble gas.

In step (S40), mixture 30 of the carbon nanotubes 10 and the metal powder 12 can be treated by a hot-pressing molding method including the following substeps of:

(S401) locating the mixture 30 between the two boards 210;

(S402) evacuating the air in the container 230 and filling a protective gas into the container 230;

(S403) applying a pressure on the mixture 30 through the two boards 210 at an elevated temperature for a period of time (e.g. about 5 hours to about 15 hours); and (S404) relieving the pressure on the mixture 30 and cooling the mixture 30 to room temperature to achieve the carbon nanotube metal composite material.

By hot pressing, the mixture 30 of the carbon nanotubes 10 and the metal powders 12 is formed into a composite material. The pressure can be in the approximate range from about 50 Mega Pascal (MPa) to about 100 MPa. The temperature can be in the approximate range from about 300° C. to about 400° C.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps. Finally, it is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. A method for making a carbon nanotube metal composite comprising:

(a) dispersing a plurality of carbon nanotubes in a solvent to obtain a suspension;

(b) adding a plurality of metal powders into the suspension, agitating the suspension, and combining by adhering the plurality of carbon nanotubes in the solvent to the plurality of metal powders by electrostatic force between the plurality of carbon nanotubes and the plurality of metal powders;

(b1) letting the suspension stand, settling the plurality of carbon nanotubes combined with the plurality of metal powders in a bottom layer of the suspension, and forming a boundary between an upper layer and the lower layer wherein the upper layer comprises mostly the solvent, the bottom layer comprises the plurality of carbon nanotubes combined with the plurality of metal powders which have been settled; and (c) reducing the solvent to obtain a mixture of the plurality of carbon nanotubes combined with the plurality of metal powders.

2. The method of claim 1, wherein the step (a) comprises the substeps of:

providing and purifying the plurality of carbon nanotubes;

functionalizing the plurality of carbon nanotubes; and dispersing the plurality of carbon nanotubes in the solvent to form the suspension of the plurality of carbon nanotubes.

3. The method of claim 1, wherein the solvent is alcohol, ethyl acetate, or N,N-Dimethylformamide.

4. The method of claim 1, wherein in the step (a), the plurality of carbon nanotubes are dispersed in the solvent by ultrasonic dispersion.

5. The method of claim 4, wherein in the process of ultrasonic dispersion, static charges cling to the plurality of carbon nanotubes.

6. The method of claim 5, wherein in the step (b), the plurality of carbon nanotubes adhere to the metal powders via electrostatic force between the plurality of carbon nanotubes and the plurality of metal powders during agitating.

7. The method of claim 1, wherein the step (c) comprises the substeps of:

filtering out the solvent to obtain the mixture of the plurality of carbon nanotubes and the plurality of metal powders; and drying the mixture of the plurality of carbon nanotubes and the plurality of metal powders.

8. The method of claim 1, wherein the metal powders are selected from the group consisting of magnesium, zinc, manganese, aluminum, thorium, lithium, silver, plumbum, and calcium.

9. The method of claim 1, wherein a volume ratio of the plurality of metal powders to the plurality of carbon nanotubes is in a range from about 1:1 to about 50:1.

10. A method for making a carbon nanotube metal composite comprising:

(a) dispersing a plurality of carbon nanotubes in a solvent to obtain a suspension containing the carbon nanotubes;

(b) adding a plurality of metal powders into the suspension containing the plurality of carbon nanotubes, agitating the suspension to make the plurality of carbon nanotubes combine with the plurality of metal powders by electrostatic force, and letting the suspension stand to obtain an upper layer and a lower layer separated by a boundary, wherein the upper layer comprises mostly the solvent, the bottom layer comprises the plurality of carbon nanotubes combined with the plurality of metal powders;

(c) reducing the solvent to obtain a mixture of the plurality of carbon nanotubes combined with the plurality of metal powders; and (d) treating the mixture of the plurality of carbon nanotubes and the plurality of metal powders with a molding process.

11. The method of claim 10, wherein in the step (a), the plurality of carbon nanotubes is dispersed in the solvent by ultrasonic dispersion.

12. The method of claim 11, wherein in the process of ultrasonic dispersion, static charges cling to the plurality of carbon nanotubes.

13. The method of claim 12, wherein in the step (b), the plurality of carbon nanotubes adhere to the metal powders via electrostatic force between the plurality of carbon nanotubes and the plurality of metal powders during agitating.

14. The method of claim 10, wherein the solvent is alcohol, ethyl acetate, or N, N-Dimethylformamide.

15. The method of claim 10, wherein the step (d) comprises the substeps of:

heating the mixture in a protective gas to achieve a semi-solid-state paste;

stirring the semi-solid-state paste using an electromagnetic stirring force to disperse the plurality of carbon nanotubes into the paste;

injecting the semi-solid-state paste into a die; and cooling the semi-solid-state paste to achieve a carbon nanotube metal composite.

16. The method of claim 10, wherein the step (d) comprises the substeps of:

locating the mixture between two boards in a container;

evacuating the air in the container and filling a protective gas into the container;

applying a pressure on the mixture through the two boards at an elevated temperature for a period of time; and relieving the pressure on the mixture and cooling the mixture to room temperature to achieve a carbon nanotube metal composite material.

17. The method of claim 16, wherein the pressure applied on the mixture is in a range from about 50 MPa to about 100 MPa.

18. The method of claim 16, wherein the elevated temperature is in a range from about 300° C. to about 400° C.

19. A method for making a carbon nanotube metal composite comprising:

(a) providing and purifying a plurality of carbon nanotubes;

(b) functionalizing the plurality of carbon nanotubes; and (c) dispersing the plurality of carbon nanotubes in a solvent to form a suspension of the carbon nanotubes;

(d) adding metal powders into the suspension containing the plurality of carbon nanotubes, agitating the suspension to make the plurality of carbon nanotubes combine with the plurality of metal powders by electrostatic force, and letting the suspension stand to obtain an upper layer and a lower layer separated by a boundary, wherein the upper layer comprises mostly the solvent, the bottom layer comprises the plurality of carbon nanotubes combined with the plurality of metal powders;

(e) reducing the solvent to obtain a mixture of the plurality of carbon nanotubes combined with the metal powders; and (f) treating the mixture of the plurality of carbon nanotubes and the metal powders with a molding process.

20. The method of claim 19, wherein in the step (d), the plurality of carbon nanotubes combine with the plurality of metal powders via electrostatic force between the plurality of carbon nanotubes and the plurality of metal powders.

* * * * *